US005137007A

United States Patent [19]

Shoemake et al.

[11] Patent Number: 5,137,007

[45] Date of Patent: Aug. 11, 1992

[54] ARCHERY SHOOTING CONTROL SYSTEM

[76] Inventors: Robert C. Shoemake, 60 Shamrock Valley Rd., Carrollton, Ga. 30117; Jesse Morehead, 748 Erwin Hill Rd., SE., Adairsville, Ga. 30103

[21] Appl. No.: 622,739

[22] Filed: Dec. 5, 1990

[51] Int. Cl.[5] ..... F41B 5/00

[52] U.S. Cl. ..... 124/87; 124/91; 33/265

[58] Field of Search ..... 124/87, 90, 91, 86; 33/265, 251

[56] References Cited

U.S. PATENT DOCUMENTS

| | | | |
|---|---|---|---|
| 3,703,770 | 11/1972 | Sofield | 33/265 |
| 3,886,924 | 6/1975 | Chesnick | 124/91 X |
| 3,930,316 | 1/1976 | Tellie | 33/251 X |
| 4,563,821 | 1/1986 | Saunders | 33/265 |
| 4,656,747 | 4/1987 | Troncoso | 124/87 X |
| 4,833,786 | 5/1989 | Shores, Sr. | 33/265 |
| 4,895,129 | 1/1990 | Hedgepath | 124/90 X |

FOREIGN PATENT DOCUMENTS

| | | | |
|---|---|---|---|
| 3405319 | 6/1984 | Fed. Rep. of Germany | 124/91 |

*Primary Examiner*—Randolph A. Reese
*Assistant Examiner*—Jeffrey L. Thompson
*Attorney, Agent, or Firm*—B. J. Powell

[57] ABSTRACT

A shooting control system for bows and arrows that cooperates with front sight pins including a bowstring sight having a base mounted in the strands of the bowstring and sight inserts selectively mounted on the base for the user to sight through using the front sight pins to aim an arrow being shot in the bow. The system also includes an arrow nok on the bowstring at the arrow noking point.

9 Claims, 5 Drawing Sheets

FIG 5
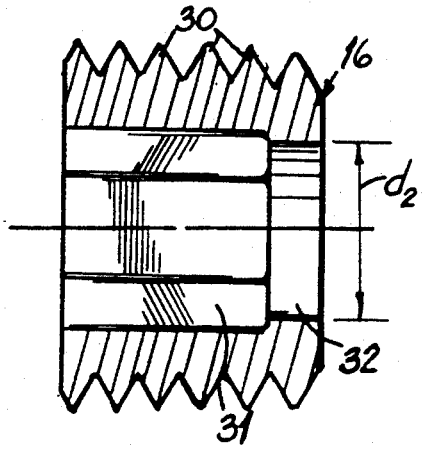
FIG 5A
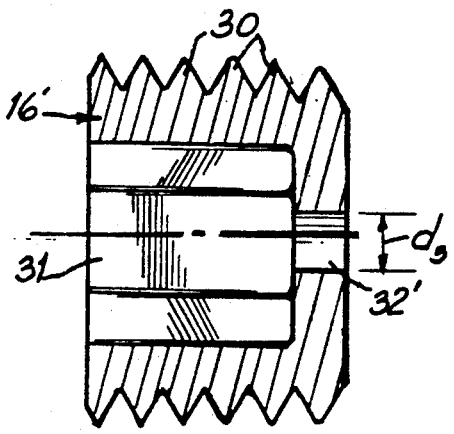
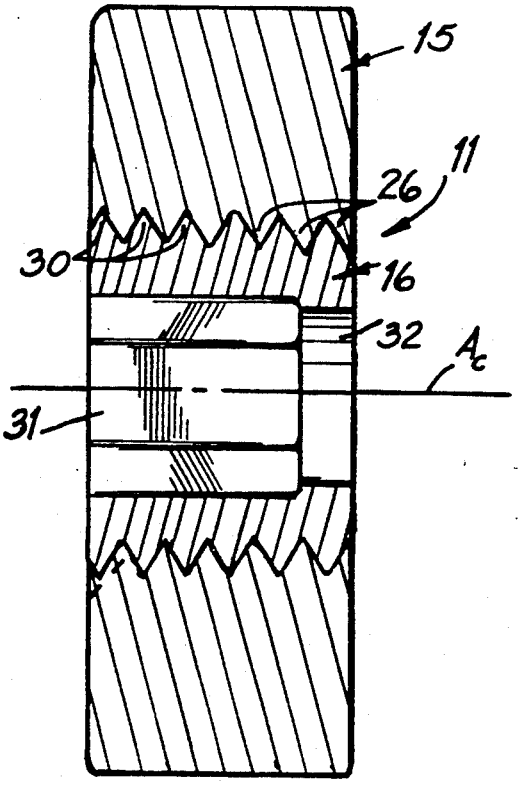
FIG 6

ARCHERY SHOOTING CONTROL SYSTEM

BACKGROUND OF THE INVENTION

This invention relates generally to archery and more particularly to sighting and noking arrangements for archery.

Current archery equipment typically uses some type of sighting equipment and some type arrow noking on the bowstring to increase accuracy. The sighting equipment typically includes a front sight and a rear sight.

A commonly used rear sight is called a peep sight and is installed in the bowstring itself. The peep sight has a fixed size sighting hole through it. Different field conditions, however, require different size holes. Thus, it is necessary to install different peep sights for these different field conditions. Because the bow has to be recalibrated each time the sight is changed, accommodating different field conditions is tedious and time consuming.

The axis of the sighting hole through the peep sight must also be correctly aligned with the front sight of accurate aiming. To control the rotational position of the peep sight, resilient members have been used to connect the bowstring in the vicinity of the peep sight to the bow. This device is clumsy and tends to interfere with the movement of the bowstring.

Various noking arrangements are currently available to keep the arrow nock located longitudinally of the bowstring. These prior art arrangements frequently bind in the arrow nock as the bowstring is released to cause shooting inaccuracies. Also, bowstring damage is frequently encountered with these prior art noking arrangements.

SUMMARY OF THE INVENTION

These and other problems and disadvantages associated with the prior art are overcome by the invention disclosed herein by providing a peep sight with interchangeable inserts, each with a different size sight hole through it so that different field conditions can be covered without having to change the entire sight. This eliminates having to recalibrate the sight each time the sight hole diameter is changed. The invention further provides a noking arrangement that serves to locate the arrow longitudinally of the bowstring while at the same time serving to rotationally orient the peep sight. This eliminates the need for a separate mechanism to maintain proper peep sight orientation.

The peep sight of the invention includes a base adapated to be mounted in the strands of the bowstring similarly to the mounting for prior art peep sights where the base defines a hole through it. At least one sight insert is adapted to be selectively mounted in the hole through the base. The insert has a different size sight hole through it than the diameter of the hole through the base. The hold through the base may be used as one diameter sight hole with the insert providing a smaller diameter sight hole. The hole through the base may be threaded and the sight insert complementarily threaded to screw into the hole in the base to install the insert. Means may be provided for selectively locking the insert into position in the base.

The noking arrangement includes a nok fixedly mounted on the bowstring at the noking position for the arrow and haing means for engaging the arrow nock to rotationally position the bowstring and thus the peep sight relative to the arrow. The nok may include a pair of locating ears provided with a clearance angle to maintain a single point of contact between each of the locating ears and the arrow nock.

These and other features and advantages of the invention will become more clearly understood upon consideration of the following detailed description and accompanying drawings wherein like characters of reference designate corresponding parts throughout the several views in which:

BRIEF DESCRIPTION OF THE DRAWINGS

FIG. 5 is an enlarged cross-sectional view of an insert of the peep sight of the invention taken along line 5—5 in FIG. 3;

FIG. 5A is a view similar to FIG. 5 of an alternate insert;

FIG. 6 is a view showing the insert in place in the base;

These figures and the following detailed description disclose specific embodiments of the invention, however, the inventive concept is not limited thereto since it may be embodied in other forms.

DETAILED DESCRIPTION OF ILLUSTRATIVE EMBODIMENTS

Figure 1:
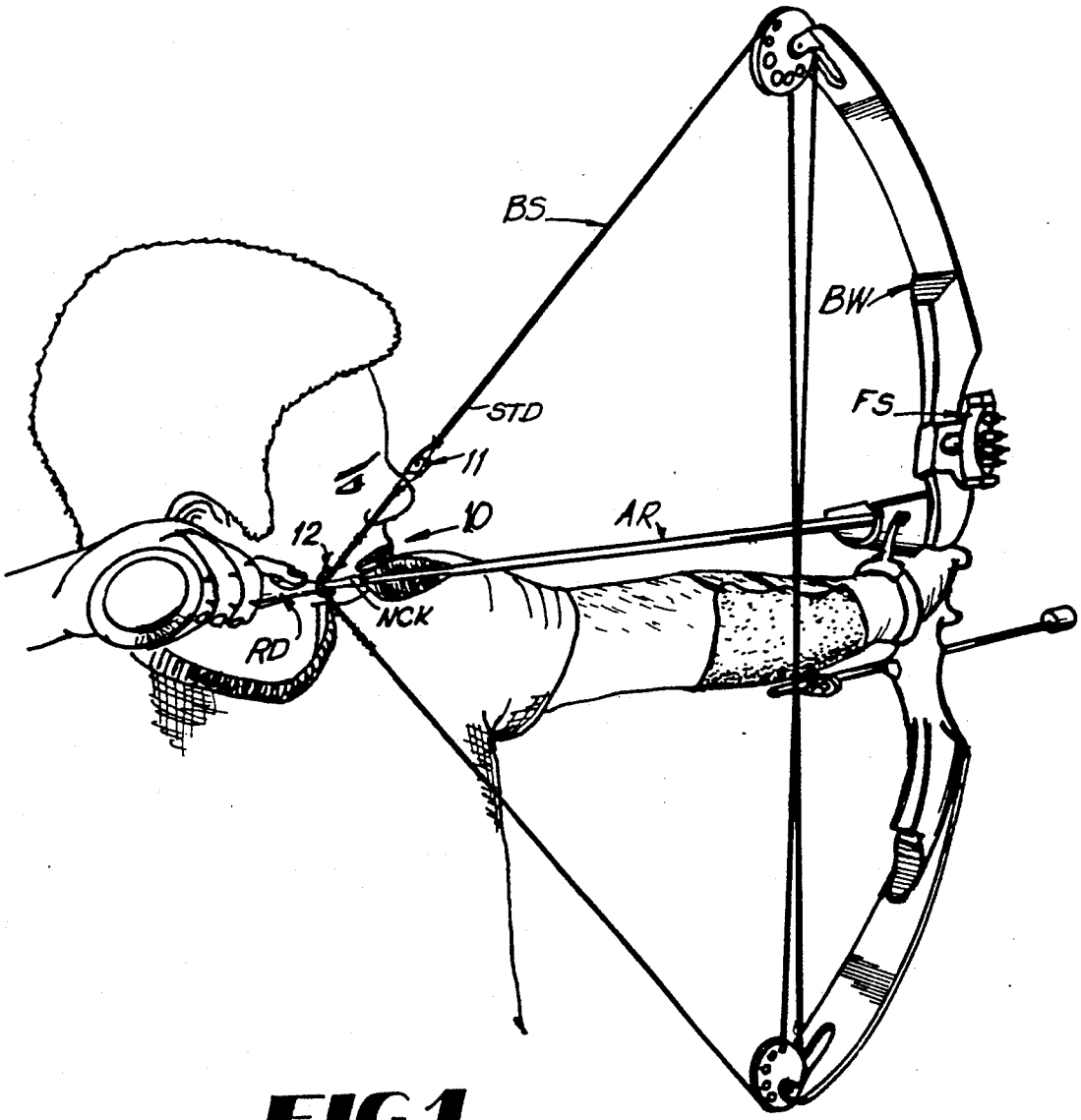
FIG. 1 is a perspective view illustrating the invention in use.

The shooting control system 10 of the invention can be applied to any bowstrings BS of a bow BW. The figures illustrate the invention 10 applied to a compound bow equipped with a pin type front sight FS and is used to align the arrow AR for shooting. As illustrated in FIG. 1, the shooting control system 10 includes a peep sight assembly 11 and a nok arrangement 12. As seen in FIG. 1, the nok arrangement 12 locates the nock NCK on the arrow AR and may be used with a string release device RD such as that shown. It will be appreciated that the shooting control system 10 may be used with any type bow and any type release including finger release by the user.

The peep sight assembly 11 is best seen in FIGS. 3—6 and includes a base 15 which is mounted in the strands STD of the bowstring BS and one or more inserts 16 that can be interchangeably mounted in the base 15. This construction provides different size sight holes through the peep sight assembly 11 for different field conditions.

Figure 2:
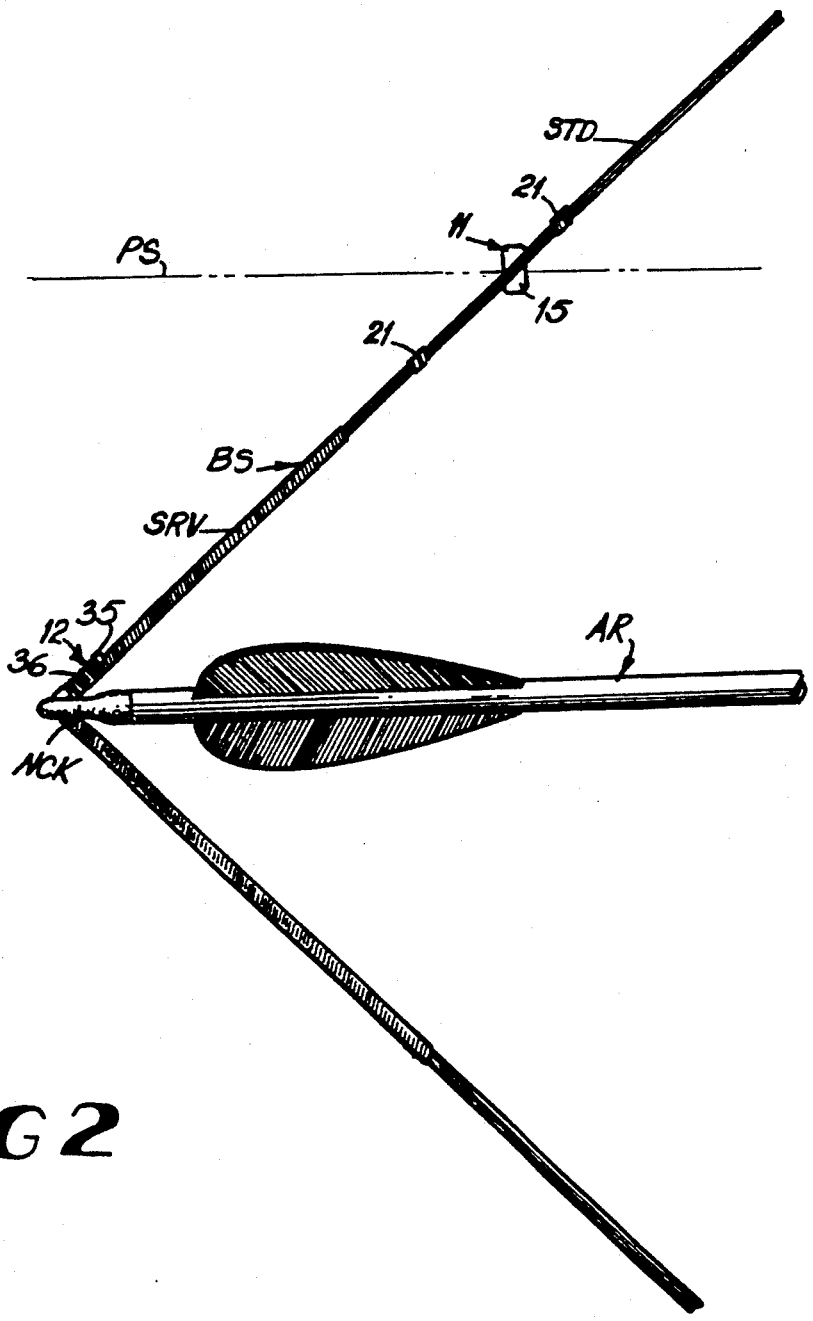
FIG. 2 is an enlarged side view of a portion of a bowstring showing the invention.
Figure 3:
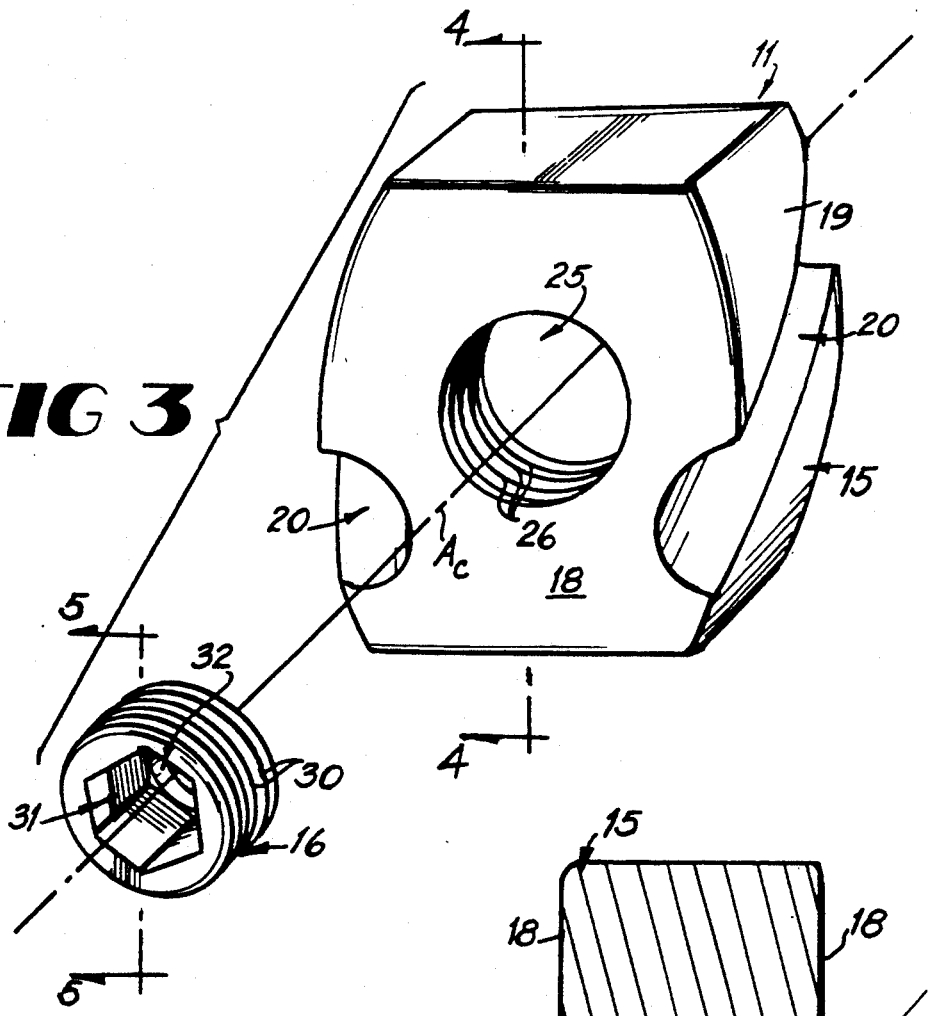
FIG. 3 is an enlarged exploded perspective view of the peep sight of the invention.
Figure 4:
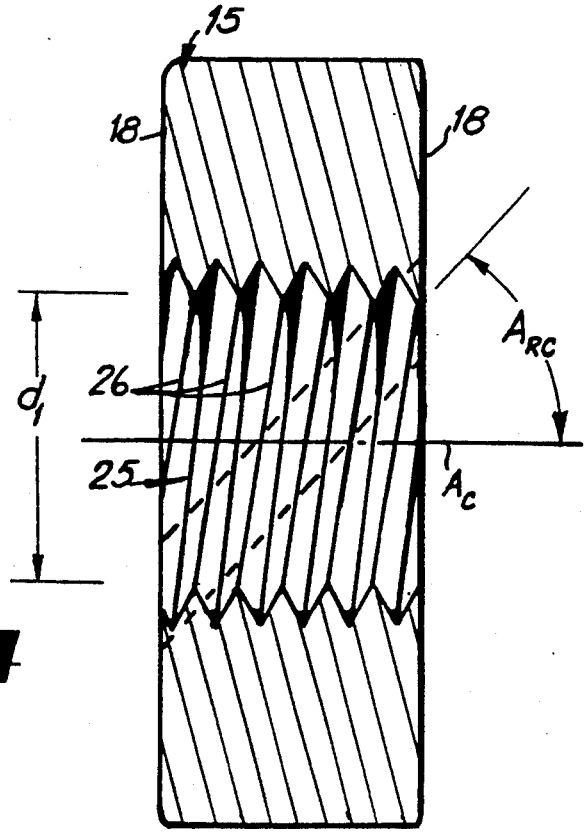
FIG. 4 is an enlarged cross-sectional view of the base of the peep sight of the invention taken along line 4—4 in FIG. 3.

The base 15 as seen in FIGS. 3 and 4 is a solid body with a central axis $A_C$ therethrough. The base 15 defines opposed faces 18 thereon perpendicular to the axis $A_C$ and opposed side edges 19. The side edges 19 each define an angled recess 20 thereacross to receive the strands STD of the bowstring BS as seen in FIGS. 1 and 2. The recesses 20 define an included angle $A_{RC}$ with respect to the axis $A_C$ as viewed from the side as in FIG. 4. The angle $A_{RC}$ is selected to maintain the axis $A_C$ in registration with the sighting path $P_S$ as seen in FIG. 2 when the bowstring BS is drawn for shooting. The archer can then sight along the path $P_S$ as seen in FIG. 1 to aim the arrow AR. The strands STD are tied together above and below the base 15 with a strong, non-abrasive filament 21 to hold it in place on the bowstring BS.

The base 15 defines a base hole 25 therethrough centered on the central axis $A_C$ with a nominal diameter $d_1$. The hole 25 is threaded with threads 26 for use in mounting the insert 16. The hole 25 is also tapered inwardly from the archer side to the bow side of the base 15 as best seen in FIG. 4. The taper is used to arrest the movement of the insert 16 into the base 15 so that the insert 16 can be positively located lengthwise of the hole 25.

The insert 16 is externally threaded with threads 30 complementary to the hole threads 26 and is also tapered so that the movement of the insert into the hole is positively arrested. To facilitate the screwing of the insert 16 into the hole 25, a wrench recess 31 is provided in the trailing end of the insert 16 as seen in FIGS. 3 and 5. While different configurations may be used for the recess 31, it is illustrated having an Allen wrench hexagonal cross-section. A sight hole 32 of diameter $d_2$ extends from the bottom of the recess 31 out the forward end of the insert 16 so the it can be used by the archer for sighting. The diameter $d_2$ is smaller than the diameter $d_1$ for use under different conditions than those with which the base hole 25 is used. It will be appreciated that different inserts 16 such as that designated 16' in FIG. 5 may be used with different diameters for the holes 32 for use in different field conditions. The hole 32' seen in FIG. 5 has diameter $d_3$ which is smaller than the diameter $d_2$.

Figure 7:
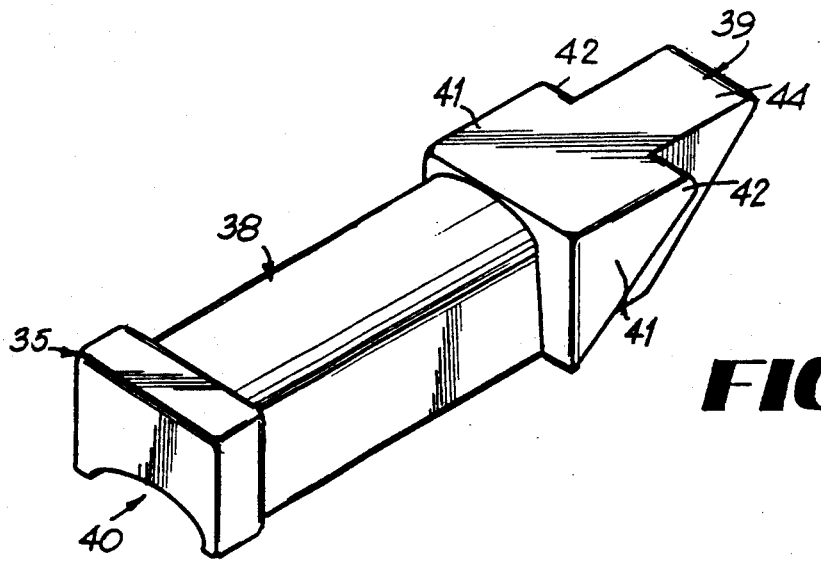
FIG. 7 is an enlarged perspective view of the nok for the bowstring.
Figure 8:
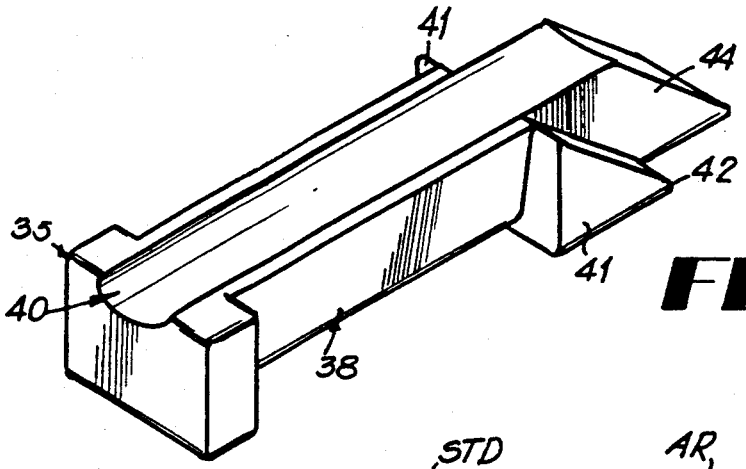
FIG. 8 is an enlarged perspective view of the other side of the nok.
Figure 9:
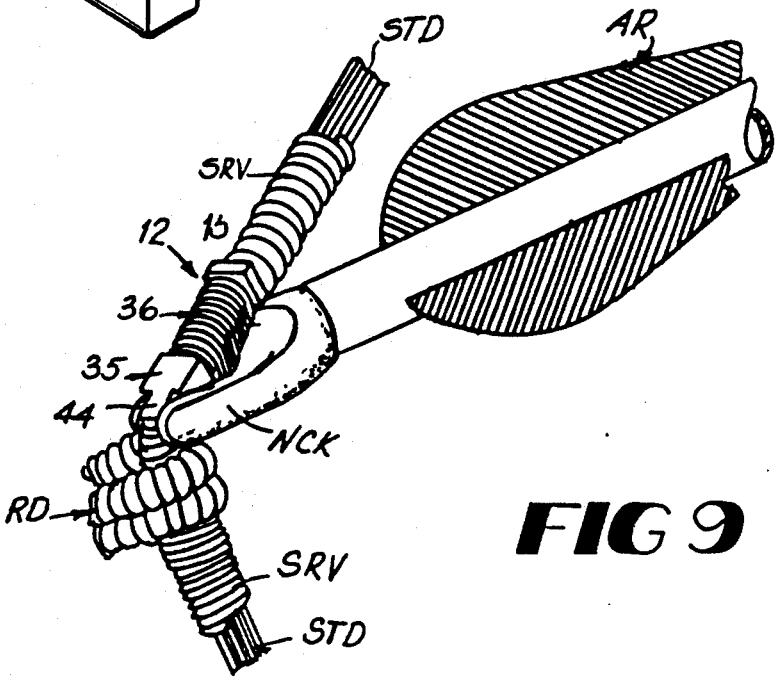
FIG. 9 is an enlarged side view of the nok installed.

The nok arrangement 12 seen in FIGS. 7—9 includes a nok 35 held on the serving SRV on the bowstring BS by a non-abrasive filament 36. The nok arrangement 12 locates the arrow nock NCK at the proper location on the bowstring for sighting and firing.

The nok 35 is an elongate member with a tie down section 38 and a noking section 39. The string side of the nok 35 is grooved as indicated at 40 to accept the serving SRV. The tie down section 38 and the serving SRV are wrapped with the non-abrasive filament 36 as seen in FIG. 9 to attach nok 35 to the bowstring BS. The noking section 39 is left free to allow it to remain at the noking point on the bowstring.

Locating abutments 41 are provided on opposite sides of the nok 35 at that end of the noking section 39 joining the tie down section 38. The abutments 41 are undercut so that the arrow nock NCK engages the abutments only at the nokin point 42 on each abutment. The tang section 44 fits into the bowstring opening in the nock NCK and rotationally fits the nok 35 an thus the bowstring BS with respect to the arrow AR. The peep sight 11 is located so that it is properly aligned for sighting when the tange section 44 is in the arrow nock NCK as seen in FIG. 9.

We claim:

1. A shooting control system for permitting sighting of bows and arrows along a sighting path where the bow has a bowstring equipped with a bowstring serving at the arrow noking point on the bowstring, said control system comprising:

a bowstring sight adapted to be installed in the strands of a bowstring for use with front sight pins on the bow, said bowstring sight including:

a base adapted to the mounted in the strands of a bowstring at a pescribed sighting location lengthwise of the bowstring, said base defining a pair of mounting recesses therein adapted to receive the strands of the bowstring therein a mount of said body at the prescribed sighting location and an internally threaded opening therethrough aligned with the sighting path when the bowstring is drawn for shooting, said threaded opening having a first prescribed diameter so that the user can sight through said threaded hole in low light conditions; and a plurality of externally threaded interchangeable sight inserts interchangeably and selectively mountable to a prescribed sight position in and substantially filling said threaded opening in said base, each of said sight inserts defining a sight opening therethrough arranged for the user to sight through said sight opening using the front sight pins on the bow to aim an arrow being shot in the bow when said insert is in said prescribed sight position, said sight opening in each of said inserts being a different fixed diameter from that of the threaded opening through said body and from that of each of te other of said inserts so that the user can selectively interchange said inserts in said body to incrementally change the diameter of said sight opening being used to sight the bow and can selectively remove said insert from said body and use said threaded opening through said base to sight the bow.

2. The shooting control system of claim 1 wherein said bowstring sight further includes releasable locking means for selectively locking each of said sight inserts in said prescribed sight position in said base.

3. The shooting control system of claim 1 wherein each of said sight inserts defines opposed ends theron and wherein said threaded opening in said base of said bowstring sight and each of said sight inserts are complementarily tapered so that the amount each of said sight insert can be screwed into said hole is controlled by the taper to locate each of said sight inserts in said base so that said opposed ends of said sight insert installed in said base are substantially flush with opposite sides of said base.

4. The shooting control system of claim 3 further including locking means for selectively locking said sight insert in position in said base.

5. The shooting control system of claim 1 for use with an installation wrench wherein each of said sight inserts of said bowstring sight defines a driving recess therein opening onto one end of said insert and having a bottom end, and extending partly therethrough along the length thereof, said driving recess adapted to drivingly receive the installation wrench therein to facilitate rotation of said insert during installation and removal with the installation wrench, said opening extending from the bottom end of said driving recess to the opposite end of said insert.

6. The shooting control system of claim 5 further including an arrow nok fixedly mounted on the bowstring serving at the arrow noking point thereon for selectively engaging the nock on the arrow to locate the arrow on the bowstring and to rotationally locate the bowstring relative to the arrow axis.

7. The shooting control system of claim 6 wherein said nok includes a noking section, a tie down section integral with said noking section at a juncture, and a pair of locating abutments at the juncture, each of said abutments defining a single elongate locating edge thereon for engagement with the nock on teh arrow and defining a clearance angle thereon sufficient to maintain said single locating edges in contact with the nock on the arrow as the bowstring moves from the drawn position for shooting toward the bow to propel the arrow forwardly.

8. The shooting control system of claim 7 wherein the noking section of said nok defines a tang thereon projecting through the opening in the nock on the arrow to maintain the arrow on the bowstring; and further including a non-abrasive filament tying said tie down section to the serving on the bowstring on only one side of the noking point on the bowstring.

9. A system for locating the nock of an arrow on the bowstring serving at the arrow noking point on the bowstring of a bow comprising:

an arrow nok including a noking section, a tie down section integral with said noking section at a juncture, and a pair of locating abutments at the juncture, each of said abutments defining a single elongate locating edge thereon oriented substantially perpendicular to the centerline of the arrow for engagement with the nock on the arrow and defining a clearance angle thereon sufficient to maintain said single locating edges in contact with the nock on the arrow as the bowstring moves from the drawn position for shooting toward the bow to propel the arrow forwardly;

said noking section of said nok defining a tang thereon projecting through the opening in the nock on the arrow to maintain the arrow on the bowstring; and a non-abrasive filament tying said tiw down section to the serving on the bowstring on only one side of the noking point on the bowstring.

* * * * *